United States Patent [19]

Hall

[11] 4,206,169

[45] Jun. 3, 1980

[54] METAL FILM COATED WITH AN AUTODEPOSITED COATING

[75] Inventor: Wilbur S. Hall, Plymouth Meeting, Pa.

[73] Assignee: Union Carbide Corporation, New York, N.Y.

[21] Appl. No.: 966,823

[22] Filed: Nov. 30, 1978

Related U.S. Application Data

[63] Continuation of Ser. No. 755,918, Dec. 30, 1976, abandoned.

[51] Int. Cl.[2] ..... B05D 1/18

[52] U.S. Cl. ..... 264/301; 427/435; 428/463; 264/299; 264/304; 264/306; 264/334; 156/344

[58] Field of Search .....427/435; 428/463; 264/301, 299, 304, 306, 334; 156/233, 344

[56] References Cited

U.S. PATENT DOCUMENTS 1,974,763 9/1934 Wirth ..... 254/238 X

FOREIGN PATENT DOCUMENTS 7741124 11/1974 South Africa ..... 427/435

OTHER PUBLICATIONS

Nascus, Metalizing of Plastics, pp. 4, 14–16 (1960).

*Primary Examiner*—Shrive P. Beck
*Assistant Examiner*—Richard Bueker
*Attorney, Agent, or Firm*—Dale Lynn Carlson

[57] ABSTRACT

A resinous coated metal film is produced by depositing metal on a support to form thereon a metal film and forming on the thus deposited metal film an autodeposited resinous coating. In one embodiment, the autodeposited resinous coated metal film is formed by immersing a metallic substrate in a modified autodepositing composition, that is, an autodepositing composition modified by the addition thereto of dissolved metal which is more noble than the metallic substrate. In another embodiment, a metal film is preformed on a metallic substrate, and thereafter the metallic substrate, having thereon the metal film, is contacted with an autodepositing composition. The metal film having thereon the autodeposited coating can be separated from the metallic substrate.

2 Claims, 2 Drawing Figures

METAL FILM COATED WITH AN AUTODEPOSITED COATING

FIELD OF THE INVENTION

This is a continuation of application Ser. No. 755,918 filed Dec. 30, 1976, now abandoned.

This invention relates to a metal film coated with an organic coating such as, for example, a resinous coating.

Metal foils or films coated with organic coatings such as resinous coatings are well known and are used in a variety of types of applications. For example, resinous coated aluminum foil and copper foil are used in preparing various types of electrical components such as capacitors and in the production of printed circuits. Resinous coated metal foils such as aluminum and zinc foils are used as packaging materials. It is also known to use resinous coated metal films as stamping foils in applications in which metal of the foil is transferred to a substrate such as paper. In addition, light reflecting surfaces comprising metal foil embedded or covered with a plastic or resinous material are known.

This invention relates to an improved method for producing a metal film or foil having thereon an organic coating such as, for example, a resinous coating.

REPORTED DEVELOPMENTS

Various methods have been used in the past for forming organic coatings on metal foils of films.

For example, U.S. Pat. No. 1,974,763 discloses the preparation of a stamping foil by depositing metal upon a support, covering the metal with a liquid acetylated cellulose ester, allowing the liquid ester to solidify and then separating both the solidified ester and deposited metal from the support.

U.S. Pat. No. 2,326,955 discloses a continuous process in which a liquid resinous material is applied to a moving web of aluminum or zinc foil in making a resinous coated foil for use as a packaging material.

It is known also to coat metal foil with resin by subjecting it to an aqueous dispersion of resin solids (for example, see U.S. Pat. Nos. 2,520,173 and 2,991,550).

U.S. Pat. No. 2,688,581 discloses a process in which a sheet of plastic material is applied to a metal foil by applying heat and pressure to a composite of the metal foil and plastic sheet.

U.S. Pat. No. 3,136,676 discloses the use of an extrusion operation to produce a metal foil embedded in plastic.

U.S. Pat. No. 3,180,781 discloses the deposition of a transparent electrically conductive metal film onto a plastic sheet by the use of thermal evaporation of the metal.

In U.S. Pat. No. 3,837,964, a metal foil such as copper foil is first treated with a specific type of complex-forming compound and thereafter the thus treated foil is coated with a plastic material.

It is an object of the present invention to provide improved articles comprising metal films having thereon organic polymeric coatings and to provide an improved process for the production of the same.

SUMMARY OF THE INVENTION

In accordance with this invention, there is provided a process for producing a metal film having thereon an organic coating comprising: (A) forming on a support a metal film; and (B) forming on the metal film on said support an autodeposited coating. In the practice of the present invention, the autodeposited coating is formed utilizing a water-based coating composition which is effective, without the aid of electricity, in forming on a metallic surface immersed therein an organic coating that increases in thickness or weight the longer the time the surface is immersed in the composition. (For convenience, a coating composition of this type is hereafter referred to as an "autodepositing composition" and a coating formed from such a composition is hereafter referred to as an "autodeposited coating".) Speaking generally, compositions which are so effective comprise acidic aqueous coating solutions having dispersed therein particles of an organic material such as resin particles. Autodeposited coatings are formed from such compositions as a result of their ability to attack and dissolve from the metallic surface metal ions in amounts which cause the particles to deposit on the surface in a manner such that there is a continuous buildup of organic coating on the surface. Exemplary autodepositing compositions are described in detail below.

The organic-coated metal films of the present invention can be produced in accordance with the present invention by various methods.

One method involves the use of what is hereafter sometimes referred to as a "modified autodepositing composition", that is, an autodepositing composition modified by having incorporated therein dissolved metal which is more noble than the metal of a metallic support on which the autodeposited coated metal film is formed. In this method, a metallic support is contacted with an autodepositing composition having incorporated therein dissolved metal which is more noble than the metal of said support. This results in the formation on the metallic support of a metal film of said more noble metal and an autodeposited coating on said metal film, that is, in the formation of a metal film sandwiched between the surface of said support and said autodeposited coating. The autodeposited coated film can be recovered by separating it from the support, if desired.

Another method for producing organic-coated metal films of the present invention involves preforming a metal film on a support and thereafter contacting said preformed metal film on said support with an autodepositing composition. This method does not rely on the formation of the metal film on the support by the autodepositing composition in that the support is provided with the metal film prior to contact with the autodepositing composition. Thus, in this method, it is not necessary to use a modified autodepositing composition. Utilizing this method, the autodeposited coated film can be recovered by separating it from the support, if desired.

DETAILED DESCRIPTION OF THE INVENTION

Figure 1:
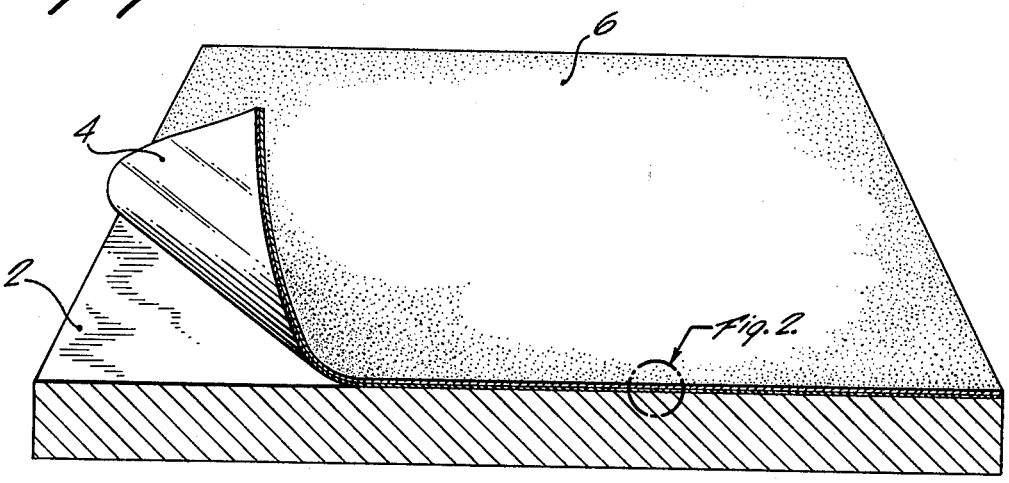
FIG. 1 is a fragmentary perspective view of an embodiment of the present invention.

Coating compositions which are effective in forming autodeposited coatings are known. Examples of such coating compositions are described in U.S. Pat. Nos. 3,585,084, 3,592,699, 3,709,743 and 3,776,848, in British Pat. No. 1,241,991, in South African Pat. No. 72/1146 and in Belgian Patent of Addition No. 811,841.

Speaking generally, the acidic aqueous coating compositions of the aforementioned type function to attack and dissolve from a metallic surface contacted therewith metal ions in an amount sufficient to directly or indirectly cause organic particles in the region of the metallic surface to deposit thereon in a continuous fashion, that is, in a manner such that there is a buildup in the amount of organic material deposited on the surface the longer the time the surface is in contact with the composition. This deposition of the organic material on the metallic surface is achieved through chemical action of the coating composition on the metal surface. The use of electricity which is necessary for the operation of some coating methods, such as the electrocoating method, is not required.

It is believed that the present invention will be used most widely in connection with coatings formed from autodepositing compositions that contain solid particles of resin dispersed in an aqueous solution containing dissolved fluoride and ferric iron, and optionally, a pigment. (For example, see South African Patent No. 72/1146.)

Preferably, the aqueous phase of the coating composition contains surfactant in an amount below the critical micelle concentration (hereafter referred to as "CMC"), and most preferably, the concentration of surfactant in the aqueous phase of the composition is below the surfactant concentration which corresponds to the inflection point on a graph of surface tension versus the logarithm of surfactant concentration in the composition. Preferably, the composition includes an anionic surfactant and the source of the resin dispersion of the composition is a latex containing surfactant in an amount such that the aqueous phase of an autodepositing composition formulated from the latex has a surfactant concentration below the CMC, preferably below the aforementioned inflection point surfactant concentration.

A particularly preferred latex has an emulsifier or surfactant content of about 1 to about 4% based on the resin solids of the latex and comprises at least 90 wt. %, most preferably 100 wt. % of an anionic emulsifier such as a sulfonate, for example, sodium dodecylbenzene sulfonate, or a sulfosuccinate, for example, sodium oleoyl isopropanolamide sulfosuccinate, or a mixture thereof.

A highly preferred autodepositing composition is prepared from the preferred latex described above, has a surfactant concentration as described above and a pH within the range of about 2 to about 3.2 and comprises about 50 to about 125 g/l of resin solids, ferric fluoride, in an amount equivalent to about 0.5 to about 2 g/l of ferric iron, and about 0.7 to about 3 g/l of HF.

Figure 2:
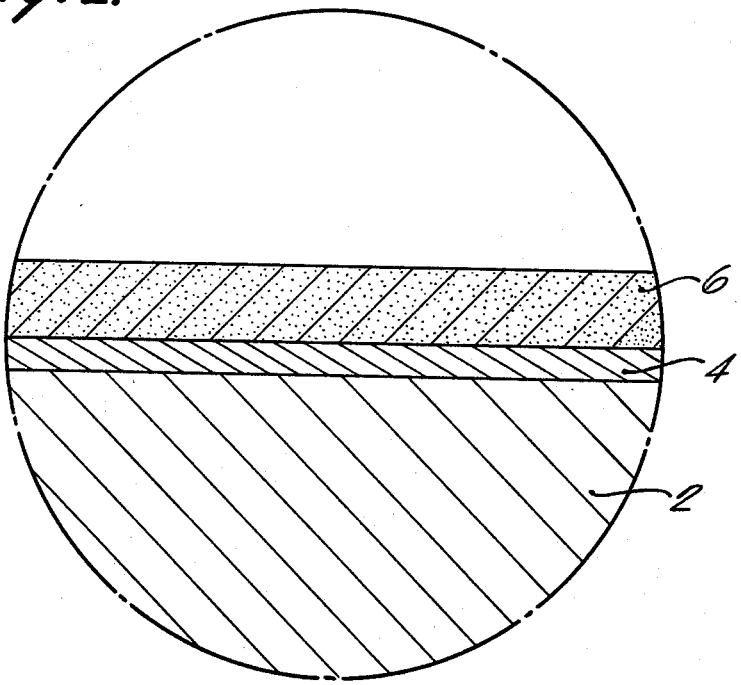
FIG. 2 is a highly enlarged fragmentary sectional view of the area enclosed by the circle shown in FIG. 1.

With reference to FIGS. 1 and 2, there is shown therein a metallic substrate 2 having thereon a metal film 4 and an autodeposited organic coating 6. It should be understood that the various components of the structure shown in the figures are not drawn to scale and are shown in exaggerated size for the purpose of illustration. In general, the metallic support or substrate 2 will be thicker than the autodeposited coating 6, which in turn can be thicker or thinner than the metal film 4. By way of example, the metal film can have a thickness within a range of about 0.0025 to about 2 mils, the autodeposited coating can have a thickness of about 0.5 to about 2 mils or greater and the metallic substrate will generally have a thickness in excess of about 30 mils. In applications, where the autodeposited coated metal film is removed from the support, the coating should be sufficiently thick to permit separation from the support without damage. In general, this can be accomplished when the coating has a thickness of at least about 0.7 mil.

One method for making the composite article shown in in FIGS. 1 and 2 is to initially form a metal film on any substrate or support capable of receiving an autodeposited coating. Any suitable method can be used to form the metal film. For example, it can be formed by chemical displacement, by electrolytic deposition or by vapor deposition. In utilizing any of these methods, the metal film is contiguous to the surface of the support. Examples of materials comprising the support are iron, including ferriferous materials, aluminum and zinc. Other materials can be used. Examples of metals that can be used in forming the metal film are gold, silver, copper, iron, tin, nickel, chromium, zinc, manganese, aluminum and magnesium. The metal film can also comprise a mixture of two or more metals or layers of two or more metals.

After forming the metal film on the substrate, the film, while supported on the substrate, is contacted with an autodepositing composition for a length of time suitable for forming an autodeposited coating of desired thickness. The organic polymeric coating-forming ingredient of the autodepositing composition is selected on the basis of the properties that are desired for the coating. Typical examples of resins that can be used are: fluorocarbon resins, for example, polytetrafluoroethylene, styrenebutadiene, polyethylene, polystyrene, polyvinylchloride, polyvinylidenechloride, ethylene-acetate copolymer and various of the acrylic resins. Pigments or dyes can be optionally included in the autodepositing composition for imparting to the coating desired colors.

Alternatively, the composite article shown in the drawings can be made in a single stage operation, that is, by contacting the substrate or support with a modified autodepositing composition which includes dissolved therein the metal for forming on the substrate the metal film. In utilizing a modified autodepositing composition, a selective sequential deposition is achieved in that the metal film initially deposits on the substrate and the autodeposited coating deposits on the metal film. In forming autodeposited coatings without the use of electricity, the metal included in the autodepositing composition is one which is more noble than the metal comprising the substrate. In effect, this results in deposition of the metal film from the autodepositing composition by chemical displacement. By appropriate selection of the metal comprising the substrate and the metal or metals included in the autodepositing composition, films of one or more metals, including the exemplary metals mentioned above, can be formed on the substrate. The amount of metal included in the autodepositing composition should be no greater than the amount of metal that is capable of being dissolved in the autodepositing composition and an amount which does not adversely effect the autodepositing composition. Although lower or higher amounts can be used, it is believed that desired results will generally be obtained by including in the autodepositing composition about 1 to about 10 g/l of dissolved metal. It should be understood that within this stated amount range, adjustments in the amount of metal used may be necessary depending on the particular metal and the particular autodepositing composition used.

The modified autodepositing composition can optionally include pigments or dyes. The organic coating-forming ingredient comprising the modified autodepositing composition can be selected utilizing the guidelines mentioned above in connection with that method by which the product of the present invention is made by performing the metal film on the support. In some applications, it may be desired to preform the metal film as described above and then contact it with a modified autodepositing composition.

Known process steps, as described hereafter, can be utilized in forming the autodeposited coating from the modified or unmodified autodepositing composition.

The autodepositing composition can be used at room temperature. However, it is noted that autodepositing compositions are effective in forming coatings on metal surfaces over a wide temperature range, including temperatures approaching the boiling point of the composition and temperatures approaching those at which the dispersed organic coating-forming particles are undesirably coagulated. There are advantages in operating at elevated temperatures. Speaking generally, the higher the temperature of the composition, the greater the rate of coating formation. Thus, at higher temperatures, the shorter the time required to produce coatings of a given thickness.

The coating composition can be contacted with the substrate or with the substrate having thereon the preformed metal film in a variety of ways, including, for example, by spray, flow coat or immersion. Immersion is preferred. The longer the metal surface is contacted with the coating composition, the greater the buildup in coating thickness. It is believed that for most applications, desired coating thicknesses can be obtained utilizing immersion times within the range of about 30 seconds to about 10 minutes. However, it should be understood that longer or shorter periods of time can be used.

Agitating the composition aids in maintaining it uniform. Also, agitation of the composition is effective in improving the uniformity of the coatings formed.

After contact with the autodepositing composition, the coated metal film can be subjected to further processing steps as are known. Such steps are described briefly hereafter.

Water rinsing the coated surface before significant drying takes place is effective in removing therefrom residuals such as acid and other materials that adhere to the coated surface. If such residuals are allowed to remain on the coated surface, they may change or adversely affect the quality of the coating. For a specific application, a determination can be made as to whether the residuals cause adverse effects which are not tolerable. If they do, they should be removed, for example, by water rinsing with tap or deionized water. If they do not, this step of removing them can be eliminated.

Fusion of the autodeposited coating renders it continuous, thereby improving its resistance to corrosion and adherence to the underlying metal film. The conditions under which a drying and/or fusion operation is carried out depend somewhat upon the type of organic coating-forming ingredient employed. In general, heat will be required to fuse the coating. The corrosion resistant properties of autodeposited coatings fused at elevated temperature have been observed to be better than coatings which have been air dried. However, there are applications where air dried coatings can be used satisfactorily. The fusion of the coating should be carried out below temperatures which cause the coating or metal film to degrade. Exemplary conditions used in fusing coatings produced according to the present invention are temperatures within the range of about 100 to about 200° C. for periods of time within the range of about 10 to about 30 minutes, depending on the mass of the coated part. Baking the coating for a period of time until the support has reached the temperature of the heated environment has been used effectively.

In applications where it is desired to use an autodeposited coated metal film free of the underlying support, the coated metal film can be removed from the support after the particles of organic coating-forming material have coalesced and the autodeposited coating has become continuous. Any suitable method can be used to remove the coated metal film from the support, including, for example, the use of mechanical means.

For some applications, it may be desired to recover the autodeposited coating free of the metal film. This can be accomplished by depositing a film of metal which is soluble in a solvent that does not dissolve or adversely affect the autodeposited coating and dissolving the metal film in the solvent (see, for example, U.S. Pat. No. 2,420,173 which discloses recovering a coating of polytetrafluoroethylene from a metal film which is soluble in acid or alkali).

The present invention can be used in the making of electrical components such as, for example, capacitors and in the manufacture of printed circuits. It can be used also in preparing coated metal foils for use as packaging materials and in preparing coated stamping foils or foils embedded in plastic for use as a light reflecting surface.

The present invention can also be used as an analytical tool. For example, it may be desirable to periodically analyze autodeposited coatings that are formed in an industrial operation. In general, autodeposited coatings are difficult to remove from the underlying metal substrate. However, when forming an autodeposited coating on a metal film as described herein, the coated metal film can be readily stripped from the underlying support. In an analytical procedure, a sample of an industrially operated autodepositing composition can be deposited on a metal film utilizing either of the methods described herein above; after stripping the autodeposited coated metal film from its support, it can be subjected to analysis, for example, spectrographic analysis.

EXAMPLES

Examples below are illustrative of the practice of the present invention.

The autodepositing composition used in the work described in Example 1 below was prepared by combining

| Ingredients | Amounts |
|---|---|
| latex containing about 54% solids | 185 g |
| ferric fluoride | 3 g |
| hydrofluoric acid | 2.3 g |
| black pigment dispersion | 5 g |
| water | to make 1 liter |

The resin of the latex used in the above composition comprised about 62% styrene, about 30% butadiene, about 5% vinylidene chloride and about 3% methacrylic acid. A film formed from the resin is soluble in refluxing chlorobenzene to the extent of about 13%. That the resin is cross-linked is indicated by its insolubility in Soxhlet extraction with chlorobenzene. The water soluble content of the latex is about 2% based on the weight of dried resin, with the water soluble content comprising about 10% sodium phosphate, about 13% sodium oleoyl isopropanolamide sulfosuccinate and about 75% sodium dodecylbenzene sulfonate, the first mentioned ingredient being a buffering agent used in preparing the latex, and the last two mentioned ingredients being emulsifiers. The pH of the latex was about 7.8 and the surface tension thereof about 45–50 dynes/cm. The average particle size of the resin was about 2,000 A.

The black pigment dispersion used in the above composition is an aqueous dispersion having a total solids content of about 36%. Carbon black comprises about 30% of the dispersion. It has a pH of about 10–11.5 and a specific gravity of about 1.17. The dispersion contains a nonionic dispersing agent for the solids, and is sold under the trademark Aquablak 115.

The first example illustrates preforming a metal film on a metallic substrate and thereafter contacting the metal-coated metallic substrate with an autodepositing composition.

EXAMPLE 1

A cold rolled steel panel (Q-panel) was immersed in an aqueous solution containing about 5 g/l of cupric sulfate pentahydrate and 3 drops/1 of 90 wt. % sulfuric acid. The panel developed a continuous rose-colored layer of copper in one minute and thereafter was withdrawn from the solution and rinsed with water. The wet copper-coated steel panel was immersed in the autodepositing composition described above for about 1 minute. The panel was then withdrawn from the composition and rinsed with water and baked for about 2.5 minutes in an oven at a temperature of 170° C. The resulting product comprised a copper film sandwiched between the surface of the steel panel and an autodeposited black resinous coating. The autodeposited resinous coated copper film was easily removed from the steel panel by finger peeling, leaving the panel completely clean of copper and autodeposited coating. The copper film was continuous, as was the autodeposited coating thereon. The coated film was flexible and could be stretched thin enough to transmit light.

Another autodeposited coated copper film was prepared in substantially the same way as described above and after separating the coated copper film from the panel, the coating on the copper film was effectively subjected to spectrographic analysis.

Tests on an autodeposited coated copper film formed in substantially the same way as described above have shown that the coated copper film is an excellent electrical conductor.

The next example shows the formation on a metal support of a metal film coated with an autodeposited coating in a one-stage operation.

EXAMPLE 2

The autodepositing composition used in this example was of the type described in U.S. Pat. No. 3,592,699, except that it was modified by incorporating therein dissolved copper. The composition was prepared from the following ingredients:

| | |
|---|---|
| styrene-butadiene latex (Pliolite 491 latex) | 100 ml |
| HF | 2.1 g |
| $H_2O_2$ | 1.7 g |
| Cu, as $Cu(NO_3)_2 \cdot 3H_2O$ | 1.5 g |
| water | to make 1 liter |

A cold rolled steel panel (Q-panel) was immersed in the above composition for 5 minutes. After withdrawal from the composition, the coated panel was rinsed with water and then baked for 10 minutes at a temperature of 190° C. There was formed on the panel a copper film sandwiched between the surface of the panel and an autodeposited coating. The coated copper film was readily removed from the surface of the panel by peeling.

In summary, it can be stated that the present invention provides a practical and efficient way for forming a composite article comprising a support coated with an autodeposited coated metal film, and for preparing a metal film coated with an autodeposited coating and for preparing an unsupported autodeposited coating. Such articles can be used in a variety of applications.

What is claimed is:

1. A process for forming a resinous coated metal film comprising contacting an iron surface with an autodepositing composition comprising resin solids, dissolved fluoride and dissolved ferric iron, and also including dissolved metal which is more noble than said iron surface, thereby forming on said iron surface a metal film of said more noble metal and on said film an autodeposited resinous coating, and removing said resinous coated metal film from said iron surface.

2. A process according to claim 1 wherein said more noble metal is copper.

* * * * *

UNITED STATES PATENT AND TRADEMARK OFFICE

CERTIFICATE OF CORRECTION

PATENT NO. : 4,206,169

DATED : June 3, 1980

INVENTOR(S) : Wilbur S. Hall

It is certified that error appears in the above-identified patent and that said Letters Patent are hereby corrected as shown below:

| | |
|---|---|
| Title page at [73] | "Union Carbide Corporation, New York, N.Y." should read --Amchem Products, Inc., Ambler, Pa.-- |
| Col. 1, line 29 | "of" should read --or--. |
| Col. 4, line 60 | "effect" should read --affect--. |
| Col. 5, line 9 | "performing" should read --preforming--. |
| Col. 6, line 23 | "2,420,173" should read --2,520,173--. |

Signed and Sealed this

*Thirtieth* Day of *June 1981*

[SEAL]

*Attest:*

RENE D. TEGTMEYER

*Attesting Officer*

*Acting Commissioner of Patents and Trademarks*